United States Patent [19]

Chen et al.

[11] Patent Number: 4,699,545

[45] Date of Patent: Oct. 13, 1987

[54] SPRAY ICE STRUCTURE

[75] Inventors: Andrie C. T. Chen; Hans O. Jahns, both of Houston, Tex.

[73] Assignee: Exxon Production Research Company, Houston, Tex.

[21] Appl. No.: 762,342

[22] Filed: Aug. 5, 1985

[51] Int. Cl.[4] ..... E02D 21/00; E02B 17/00

[52] U.S. Cl. ..... 405/217; 405/195; 405/60; 62/260

[58] Field of Search ..... 405/217, 61; 62/259.1, 62/260

[56] References Cited

U.S. PATENT DOCUMENTS

| | | | |
|---|---|---|---|
| 3,738,114 | 6/1973 | Bishop | 405/217 |
| 3,750,412 | 8/1973 | Fitch et al. . | |
| 3,766,737 | 10/1973 | Howard . | |
| 3,849,993 | 11/1974 | Robinson et al. | 405/217 |
| 3,863,456 | 2/1975 | Durning . | |
| 4,048,808 | 9/1977 | Duthweiler . | |
| 4,094,149 | 6/1978 | Thompson et al. . | |
| 4,094,419 | 6/1978 | Thompson et al. | 405/217 |
| 4,192,630 | 3/1980 | Duthweiler . | |
| 4,456,072 | 6/1984 | Bishop | 405/217 |
| 4,523,879 | 6/1985 | Finucane et al. . | |
| 4,555,879 | 11/1985 | Lagner | 405/217 |

OTHER PUBLICATIONS

Offshore Outlook: The American Arctic Mechanical Engineering; May 1985.

Shio Sprayed Ice Island Proposal Sohoio Petroleum Company; Jan.. 1985.

Exxon Ice Barrier Test Article Ocean Industry Apr. 1984.

Tarsiut Winter Alert Monitoring by B. D. Wright, Gulf Canada Resources Inc., and J. S. Weaver, I. S. E. Engineering Consultants, Ltd. 1983 Offshore Technology Conference.

Artificial Ice Islands Could Cut Arctic Cost; The Oil and Gas Journal–Nov. 11, 1974, pp. 173–181.

OTC Paper 4517 Entitled "Design and Construction of Tarsuit Island in the Canadian Beaufort Sea" by J. Fitzpatrick et al., Presented at the 15th Annual Offshore Technology Conference, Houston, Tex., May 2–5, 1983

Article Entitled Drilling Unit Made of Converted Tanker Hull from *Ocean Industry,* Nov., 1983, pp. 13 and 15.

Paper Entitled "Ground Ice Pads as Drilling Bases in the Beaufort Sea" by T. S. Kemp, presented at a symposium of the International Association of Hydraulic Research, Hamburg, Federal Republic of Germany, Aug. 27–31, 1984 Article Entitled The Unheralded Outpost of Antares by R. G. Burke, from *Offshore,* Feb., 1985, p. 9.

*Primary Examiner*—Dennis L. Taylor

*Attorney, Agent, or Firm*—Kenneth C. Johnson

[57] ABSTRACT

The present invention provides an approach for drilling offshore arctic wells in areas covered by floating ice. A grounded spray ice drilling structure having an inner drilling platform portion and an outer barrier portion which are contiguous is constructed by withdrawing water from beneath the ice sheet and spraying the water through the air when the air is below the freezing temperature of the water. This causes the water to freeze into spray ice as it passes through the air. The resulting spray ice is deposited on the ice sheet to build up the grounded spray ice drilling structure. The outer barrier portion is built up to a greater freeboard than the inner drilling platform portion, and is adapted to laterally confine the inner drilling platform portion and to protect the inner drilling platform portion from natural ice forces.

25 Claims, 4 Drawing Figures

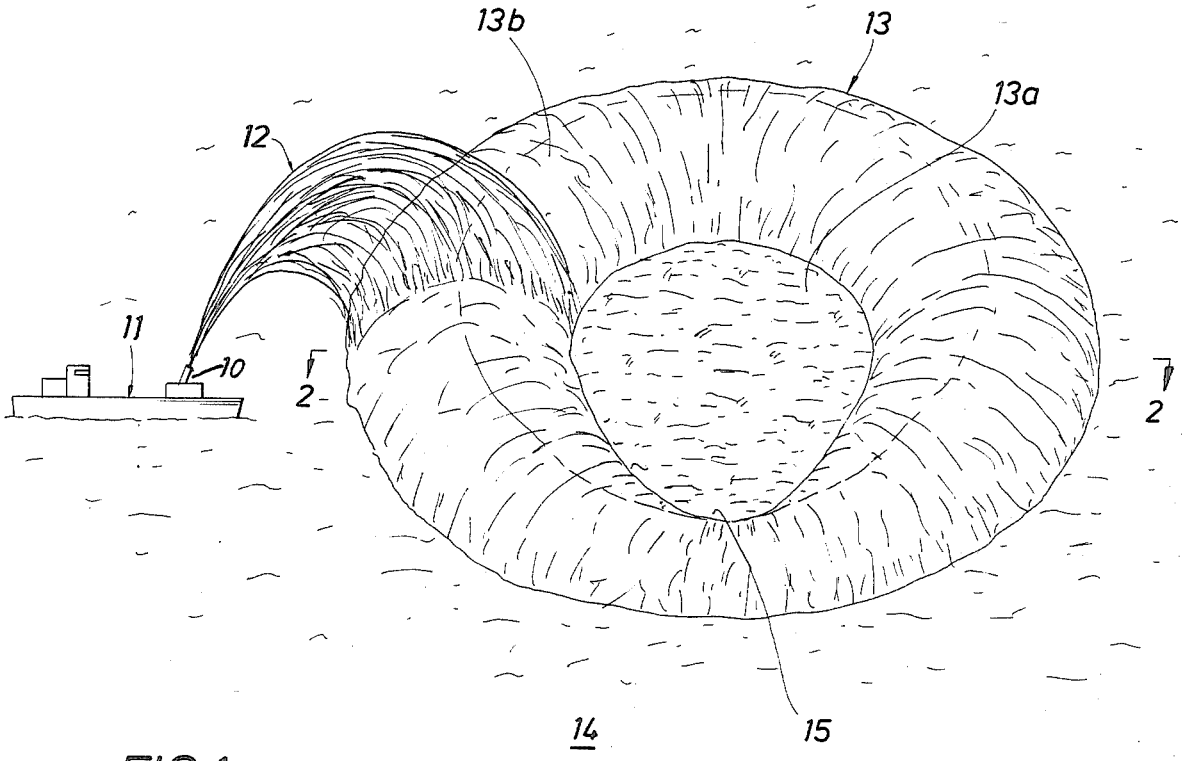
FIG. 1
FIG. 2
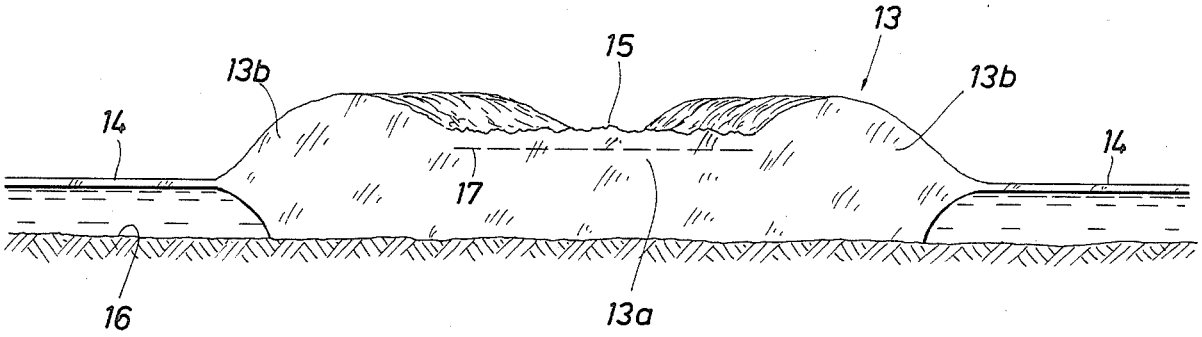

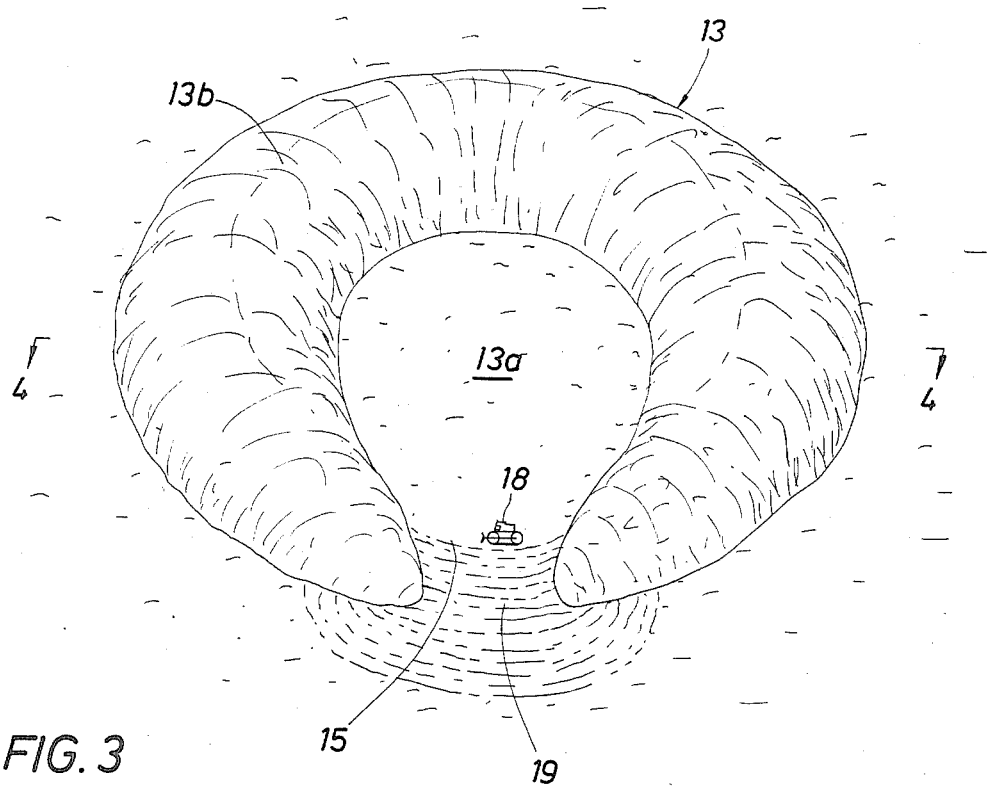
FIG. 3
FIG. 4
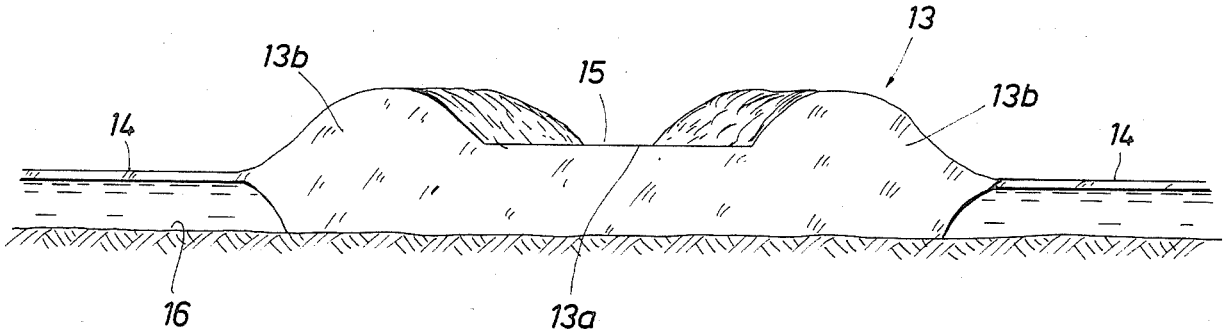

SPRAY ICE STRUCTURE

FIELD OF THE INVENTION

The present invention relates to offshore arctic operations. More particularly, the present invention relates to spray ice structures useful for offshore arctic drilling.

BACKGROUND OF THE INVENTION

The vast continental shelf region extending along the north coast of Alaska and Canada in the Beaufort Sea is currently regarded as having some of the best potential for large new petroleum discoveries in North America. For this reason, the region is presently undergoing exploration activity. Offshore exploration activities are almost always more expensive than onshore exploration activities, but special problems faced in offshore arctic regions such as the Beaufort Sea result in some of the most expensive exploration activities ever undertaken, with the cost of drilling an exploratory well in some cases exceeding one hundred million dollars. For this reason, there has been great incentive to develop approaches for drilling wells in offshore arctic regions which are so cost effective as possible without subordinating safety and environmental concerns. Before describing some of the drilling approaches which have been used and proposed, a brief description of the unique problems encountered in offshore arctic drilling operations will be given.

The biggest problem facing drilling operations in offshore arctic regions such as the Beaufort Sea is the presence of sea ice. During the brief summer open water season, sea ice is generally not a problem, except when strong north winds blow large bodies of multiyear ice into the coastal regions from the permanent polar ice cap which lies far to the north. During the open water season, relatively conventional drilling vessels can be used to drill exploratory wells. However, the open water season is short, typically lasting for only two or three months. In bad ice years, the open water season can be even shorter. A further time constraint is imposed by governmental regulations which prohibit drilling during parts of the open water season.

During most of the year, the presence of sea ice makes the use of unprotected drilling vessels unsafe and impractical. The sea generally begins to freeze up in early October, leading to the gradual formation of a stationary landfast ice zone in nearshore waters. Beyond this landfast zone lies the transition zone. The transition zone extends from the landfast zone seaward to the permanent polar ice cap. Unlike the stationary ice in the landfast zone, the ice in the transition zone is highly mobile ice called pack ice. During the early part of the winter, the boundary of the landfast zone moves seaward, stabilizing near the sixty foot water depth contour in early Jan. For the most part, the stationary ice of the landfast zone and the pack ice of the transition zone consist of annual ice which starts out very thin and grows to a thickness of about six feet by mid winter. Embedded within the annual ice are much thicker ice features originating from the permanent polar ice cap or resulting from ice deformation caused by movements within the transition zone. Some of the thicker ice features are so large that they are able to survive the brief open water season, thereby becoming multiyear ice features.

Of the two annual ice zones, the landfast zone poses less problems to drilling operations because it is relatively stationary. Nevertheless, compressive forces which develop as the landfast ice thickens make the use of conventional drilling vessels unattractive. In addition, the boundary of the landfast zone can quickly recede toward shore under the influence of strong winds, especially in the early winter when the annual ice cover is not yet very thick. Thus, except in areas which are quite close to shore, the pack ice of the transition zone must usually be regarded as a threat.

What makes pack ice so threatening is its mobility. Whenever moving pack ice encounters a stationary object, compressive forces develop. In general, the thicker the ice, the greater the compressive forces. The greatest compressive forces develop when the large multiyear ice features embedded within the pack ice encounter stationary objects. Because of the compressive forces which can develop, unprotected drilling vessels have not been used for winter drilling operations. Even if the drilling vessel hull were made strong enough to resist the compressive forces, the mooring system might not be able to keep the vessel stationary, and the well being drilled could be lost as the vessel is pushed off location. Consequently, special approaches for winter drilling in the Beaufort Sea have been used and proposed.

The most common approach which has been used is to build a gravel island at the drilling location and to place a drilling rig on top of the gravel island. Gravel islands are capable of resisting the compressive ice forces due to their enormous mass and the inherent strength of gravel. As annual pack ice moves against a gravel island, it breaks and piles up, forming grounded ice rubble adjacent to the gravel island. This grounded ice rubble provides additional protection for the gravel island against large multiyear ice features embedded in the pack ice. Ideally, grounded ice rubble will form around the gravel island before any encroachment by multiyear ice. Although gravel islands have been used successfully to drill offshore arctic wells, they have a number of serious drawbacks. Gravel islands are extremely expensive to build and require a great deal of construction time.

Several variations of the gravel island approach have also been used. In one approach, a berm is constructed in essentially the same manner as a gravel island, except that construction of the berm ceases when its top is still well below the water's surface. The top is then leveled, and steel caissons are placed on top of the berm to define an enclosed area. The steel caissons extend above the water's surface and together form a ring. Gravel or sand is dumped into the caisson ring to build up a caisson retained island. This approach has the advantage of requiring less fill material and of avoiding the severe wave erosion problems faced by gravel islands. A similar approach is to build an underwater berm with a level top and then to ballast a steel drilling structure onto the top of the berm. The strong steel sides of the structure resist compressive forces imposed by moving pack ice and the ballast prevents the pack ice from pushing the structure off the berm. In this approach, even less fill material is required, but the cost savings are at least partially offset by the greater cost of the drilling structure relative to a caisson ring. Despite their advantages over gravel islands, both of these berm approaches are still very expensive and require a great deal of construction and preparation time before drilling can begin.

Another approach to offshore arctic drilling is to use a massive bottom-founded drilling structure. The strong sides of the structure resist crushing forces, and the mass and foundation of the structure keep it from being pushed off location. One advantage of this approach over those previously described is that time delays are minimal since no gravel island or berm has to be constructed. Another advantage is that unlike a gravel island or berm, the structure can be moved to drill at more than one location. However, like the drilling approaches which use gravel islands and berms, the use of a bottom-founded drilling structure is very expensive.

One approach which has been proposed for offshore arctic drilling is to use a relatively inexpensive drilling vessel protected by a spray ice barrier. A horseshoe-shaped spray ice barrier would be constructed using high output spray monitors which shoot streams of seawater through the air at times when the air is below the freezing temperature of the seawater, thus forming spray ice. Thousands or millions of tons of spray ice would be deposited in this manner until a grounded spray ice barrier has been constructed. The drilling vessel would then be moved into the protected enclosure formed by the horseshoe-shaped barrier. The enormous mass of the grounded spray ice barrier would enable it to resist the moving pack ice and to thereby protect the drilling vessel.

The spray ice barrier approach holds much promise because it is far less expensive than the winter drilling approaches described above. Thanks to the low cost and the rapid vertical buildup rates achievable with the spray ice barrier construction method, this approach holds more promise than gravel islands and berms for offshore arctic drilling in deeper waters. The spray ice barrier approach is also far less expensive than the bottom-founded drilling structure approach described above. To date, spray ice barriers have been used to provide additional protection for bottom-founded and berm-founded drilling structures and caissons. This experience may soon lead to the use of drilling vessels protected by spray ice barriers for offshore arctic drilling. Nevertheless, the arctic drilling vessels which would be used in the spray ice barrier approach are still quite expensive, and their availability may be limited for some time to come.

The high cost of arctic gravel islands, berms, bottom-founded drilling structures and drilling vessels has led to the development of approaches which rely on drilling platforms made of ice. One approach which has been used is to construct an ice island made of solid ice which is formed by a flood-and-freeze process. Thin layers of water are deposited on top of annual ice which forms at the drilling location. Each layer of water is allowed to freeze before more water is added. The flood-and-freeze process is repeated until an ice island of desired thickness has been constructed. Because the ice island must not be allowed to move during drilling, construction usually continues until the ice island becomes grounded on the sea floor. However, due to the slow vertical buildup rates achievable with the flood-and-freeze process, constructing a grounded ice island by this process is practical only in shallow water. Ungrounded ice islands have been used, but they are practical only in some relatively unusual areas of deep water landfast ice, such as between the closely-spaced Arctic Islands of Canada. Thus, the use of ice islands constructed by the flood-and-freeze process is limited to a very small percentage of the offshore arctic regions currently being explored.

The limitations imposed by the slow vertical buildup rates achievable with the flood-and-freeze process have led to proposals to build drilling platforms out of spray ice. A grounded spray ice drilling platform would be constructed in much the same manner as a spray ice barrier, taking advantage of the rapid vertical buildup rates achievable with the spray ice process. Unlike spray ice barriers however, a spray ice drilling platform must have a good working surface. To date, no operational grounded spray ice drilling platforms have been constructed, but grounded spray ice relief well platforms have been constructed next to caisson retained islands for use in the event of a blowout of the well being drilled from the island. Because no blowouts have occurred, these spray ice relief well platforms have not been used for drilling. In most cases, spray ice relief well platforms have been built by first leveling grounded ice rubble which forms next to caisson retained islands. Spray ice is then deposited intermittently, allowing earth moving equipment to level and compact the spray ice in layers. The grounded ice rubble provides a firm foundation for the spray ice, so that spray ice only has to be added on top of the grounded ice rubble to form the platform. This is highly advantageous because spray ice has a tendency to settle and crack. The greater the volume of spray ice that has to be used to construct the platform, the greater the tendency for settlement and cracking. The presence of a grounded ice rubble foundation minimizes the volume of spray ice that has to be used to construct the platform, thereby minimizing settlement and cracking.

Another advantage of building spray ice drilling platforms on top of grounded ice rubble results from the greater density of the ice rubble relative to spray ice. This gives the platform more mass for the same height and hence increases sliding resistance. A spray ice platform constructed on floating ice could of course be built to a higher freeboard to achieve the same sliding resistance. Unfortunately however, this higher freeboard would aggravate the settlement and cracking problem due to the greater volume of spray ice required. In addition, the higher freeboard would make access to the spray ice drilling platform difficult.

A further advantage of building spray ice drilling platforms on top of grounded ice rubble results from the fact that ice rubble has greater compressive strength than spray ice. Thus, a spray ice drilling platform built on top of grounded ice rubble is less likely to be deformed by pack ice movements than a spray ice drilling platform lacking such a foundation. For obvious reasons, any deformation of a drilling platform should be avoided.

All of the advantages of building spray ice drilling platforms on top of grounded ice rubble foundations can only be realized if grounded ice rubble forms at the desired drilling location. In the case of spray ice relief well platforms used in conjunction with stationary drilling structures such as caisson retained islands, odds are good that grounded ice rubble will form next to the stationary structure. However, the odds that grounded ice rubble will form at a desired drilling location in the absence of a stationary structure are low, especially in deeper waters. Drilling plans of course cannot be based on such low odds. Therefore, if spray ice drilling platforms are ever to realize their potential, an approach will have to be developed for overcoming the settlement, cracking, sliding resistance and compressive strength problems facing spray ice structures which are constructed on floating ice. The present invention is aimed at providing such an approach.

SUMMARY OF THE INVENTION

Briefly, the present invention is a method for building a grounded spray ice structure suitable for drilling operations at an offshore location which is covered by a floating ice sheet. Water is withdrawn from beneath the ice sheet and is sprayed in a stream through the air at times when the air is below the freezing temperature of the water, thus resulting in the formation of spray ice as the water passes through the air. The resulting spray ice is deposited on the ice sheet. Spraying continues and the stream is directed to cause the deposited spray ice to build up into a grounded spray ice structure having an abutting inner drilling platform portion and an outer barrier portion The outer barrier portion is built up to a greater freeboard than the inner drilling platform portion. The outer barrier portion is built up until it is adapted to laterally confine the inner drilling platform portion and to protect the drilling platform portion from natural ice forces.

In the preferred embodiment, the inner drilling platform portion is built up before the outer barrier portion and is surcharged with spray ice to aid compaction. The surcharge of spray ice is later removed, and the inner drilling platform portion is leveled to provide a good working surface. An opening is left in the outer barrier portion to provide a passageway to the inner drilling platform portion. The surcharge of spray ice removed from the inner drilling platform portion can be used to make an access ramp through the passageway.

BRIEF DESCRIPTION OF THE DRAWINGS

FIG. 1 is a perspective view of a spray ice structure being built up by water sprayed from an icebreaker.

FIG. 2 is a cross-sectional view of the spray ice structure taken along line 2—2 of FIG. 1.

FIG. 3 is a perspective view showing the spray ice structure being worked on by a bulldozer.

FIG. 4 is a cross-sectional view of the spray ice structure taken along line 4—4 of FIG. 3.

DESCRIPTION OF THE PREFERRED EMBODIMENT

Referring to FIG. 1, water monitor 10 on icebreaker 11 can be seen spraying water stream 12 through the air to build up spray ice drilling structure 13. At the point in time depicted in FIG. 1, spraying is near completion. Earlier, spraying was begun after the natural formation of floating ice sheet 14 at the desired offshore arctic drilling location. If the spray ice drilling structure is constructed during the fall or early winter when the ice sheet is relatively thin, then a vessel such as icebreaker 11 is preferred for conducting the spraying. On the other hand, if the spray ice drilling structure is constructed during the late winter or spring, then vehicles (not shown) such as trucks or sleds equipped with water monitors can be used. By moving the vessel or vehicle and by aiming the water monitor, spraying can be conducted regardless of wind direction. This permits spraying to be conducted essentially uninterrupted, except during periods of warm weather, thereby speeding construction of the spray ice drilling structure. Of course, multiple water monitors deployed on one or more vessels or vehicles can be used to further speed construction.

Spraying techniques and equipment for making spray ice are well known to those skilled in the art, and are described for example in U.S. Pat. 4,523,879, the disclosure of which is incorporated herein by reference. Water is withdrawn from beneath floating ice sheet 14 and is sprayed upwardly and laterally in stream 12 through the air when the air is below the freezing temperature of the water. This causes a substantial amount of the water to freeze into spray ice as it passes through the air. The spray ice is deposited on the ice sheet at the desired drilling location to build up spray ice drilling structure 13, which is grounded on the sea floor. The spray ice drilling structure is comprised of two abutting portions, inner drilling platform portion **13*a* and outer barrier portion 13*b***.

Preferably, the inner drilling platform portion is built up first and is surcharged with spray ice to a higher freeboard than the design freeboard. The surcharge of spray ice is later removed, as will be described in more detail below. Building up the drilling platform portion first has at least two advantages. First, concentrating the output of the water monitor onto the spot where the drilling platform portion is to be constructed permits rapid grounding of the ice sheet. Rapid grounding is preferred to quickly stabilize the ice sheet against possible movement. This permits the remainder of the spray ice drilling structure to be constructed without the disruption which could result if the ice sheet were to start moving. Second, by building up the drilling platform portion first, it is given more time to compact under its own weight. Maximum compaction of the drilling platform portion is preferred to provide a good support surface for drilling equipment, supplies and facilities which are mobilized onto the drilling platform portion after construction of the spray ice drilling structure is completed. The weight of the surcharge of spray ice facilitates compaction.

After the drilling platform portion has been built up and surcharged, the water monitor is aimed to build up outer barrier portion **13*b*, which surrounds most or all of the drilling platform portion. The barrier portion is built up to a greater freeboard than the drilling platform portion. Spraying is continued until the barrier portion is adapted to laterally confine the drilling platform portion and to protect the drilling platform portion against natural ice forces. An opening is preferably left in the barrier portion to form passageway 15**, which provides access to the inner drilling platform portion. The passageway should preferably be on the side of the spray ice drilling structure which is least subject to pack ice encroachment. Typically, this will be the side facing shore.

Referring to FIG. 2, a cross-sectional view of spray ice drilling structure 13 taken along line 2—2 of FIG. 1 is shown. As can be seen, the spray ice drilling structure is grounded on sea floor 16. The high freeboard of barrier portion **13*b* gives the spray ice drilling structure sufficient sliding resistance to resist pack ice movements. This eliminates the need to build drilling platform portion 13*a*** to such a high freeboard which could aggravate settlement and cracking and could make vehicular access to the drilling platform portion very difficult. The high freeboard and great width of the barrier portion also keep the drilling platform portion from being deformed by the compressive forces which can be imposed by moving pack ice. The high freeboard and great width of the barrier portion further enable it to laterally confine the spray ice of the drilling platform portion. Lateral confinement counteracts the tendency for creep and horizontal strain in the spray ice of the drilling platform portion, thereby minimizing cracking and eliminating edge defects which could otherwise result from settlement. Being made of spray ice, the barrier portion will of course be subject to deformation by moving pack ice and to settlement and cracking. However, because no drilling operations are carried out on the barrier portion, this does not cause a problem.

The dimensions of the spray ice drilling structure will vary depending on a number of factors, foremost of which are water depth, design ice loads and the amount of space needed for drilling equipment, supplies and facilities. In general, spray ice initially behaves like a granular material such as sand, and gradually consolidates over time. Therefore, well known soil mechanics principles can be used to calculate the freeboard and width for the barrier portion to resist the design ice loads for the drilling location. With respect to the surcharge of spray ice deposited on the drilling platform portion, its weight should preferably equal or exceed the weight of the drilling equipment, supplies and facilities which will be placed on the drilling platform portion after completion of the spray ice drilling structure. By way of example, a spray ice drilling structure designed to drill one or more wells in the Beaufort Sea in water thirty feet deep might have the following dimensions: overall diameter—1000 feet; diameter of drilling platform portion—400 feet; width of barrier portion—300 feet; freeboard of barrier portion—50 feet; freeboard of drilling platform portion—20 feet, plus 10 to 20 feet of surcharge. Dotted line 17 in FIG. 2 indicates the design freeboard of the drilling platform portion. The spray ice above the dotted line is the surcharge. Spray ice drilling structures designed for drilling in deeper waters would have larger dimensions.

Once all portions of the spray ice drilling structure are built up to the desired dimensions, spraying is stopped and construction continues with removal of the surcharge of spray ice from the drilling platform portion. If desired, additional time for self compaction of the drilling platform portion can be provided between completion of spraying and removal of the surcharge, but in general, this should not be necessary. Of course, removal of the surcharge could commence before spraying is completed if time considerations so dictate, but it is preferable to wait until spraying is completed. This not only gives the spray ice of the drilling platform portion more time to compact under the weight of the surcharge, it also eliminates the chance that unwanted spray ice will be deposited due to wind effects on the drilling platform portion after the surcharge is removed.

As seen in FIG. 3, removal of the surcharge of spray ice from drilling platform portion 13*a* can be accomplished using earth moving equipment such as bulldozer 18. At the point in time depicted in FIG. 3, removal of the surcharge is almost complete. While removing the surcharge, the bulldozer also levels the drilling platform portion to provide a good working surface. The surcharge of spray ice can be simply pushed outward into the barrier portion or can be removed from the spray ice drilling structure altogether. Preferably, some or all of the surcharge of spray ice is used to build ramp 19 which extends through passageway 15. The ramp makes vehicular access to the inner drilling platform portion easier.

While removing the surcharge of spray ice, the weight of the earth moving equipment further compacts the drilling platform portion. The weight of the earth moving equipment also compacts the ramp during its construction. If desired, the drilling platform portion and ramp can be further compacted using heavy rollers or other equipment. When construction is completed, drilling platform portion 13*a* has a level, compacted surface as seen in FIG. 4, which is a cross-sectional view taken along line 4—4 of FIG. 3.

After construction is completed, rig mats (not shown) are preferably placed on the surface of the drilling platform portion to provide additional support. Drilling equipment, supplies and facilities (not shown) are then mobilized onto the drilling platform portion. If the spray ice drilling structure is completed during the fall or early winter when the annual ice cover is still relatively thin, helicopters may be used to transport the equipment, supplies and facilities to the drilling site. If, on the other hand, mobilization is to occur in late winter or spring when the annual ice cover is thick, trucks operating on ice roads may be used for transportation.

Careful thermal design of the drilling facilities, especially heated buildings, is required to prevent melting of the spray ice surface of the drilling platform portion. Careful thermal design of a moonpool (not shown) which extends vertically through the drilling platform portion for drilling a well is also required to prevent melting of the spray ice surrounding the moonpool. Means such as insulation for preventing melting are well known to those skilled in the art.

If desired, additional protective measures well known to those skilled in the art, such as cutting slots (not shown) around the spray ice drilling structure with ditching machines (not shown), can be used to minimize natural ice forces. However, for most applications, the outer barrier portion should be able to provide all the protection needed if made sufficiently large.

The outer barrier portion of the spray ice drilling structure in addition to providing the benefits discussed above will also serve to protect the inner drilling platform portion from wave attack for a substantial period of time after breakup of the annual ice cover in the summer. Likewise, the barrier portion will protect the drilling platform portion from encroachment by the many large free-floating bodies of ice which drift about after breakup. Thus, the useful life of the spray ice drilling structure should extend well into the open water season. If the open water season is brief, the spray ice drilling structure might be able to survive and be used through another winter season. Additional spray ice could be added whenever the air drops to a sufficiently low temperature. Spraying would be conducted either from a vessel or from the spray ice drilling structure itself. After drilling is completed, the spray ice drilling structure is simply abandoned by removing the rig mats, drilling equipment, supplies and facilities, and is allowed to melt with little or no environmental impact.

As described above, the present invention provides a fast, economical and practical approach for drilling offshore arctic wells in areas covered by floating ice. The settlement, cracking, sliding resistance and compressive strength problems facing spray ice structures are overcome by the present invention without the need to rely on a grounded ice rubble foundation. Thus, compared to spray ice drilling platform approaches which rely on grounded ice rubble foundations, the present invention can permit the drilling of wells in a much higher percentage of the offshore arctic regions currently being explored.

Compared to offshore arctic drilling approaches which use gravel islands, berms, bottom-founded drilling structures or drilling vessels, the savings which can be realized through practice of the present invention are substantial. In addition, the construction time required before drilling can begin is greatly reduced when compared to approaches which use gravel islands, berms or ice islands formed by the flood-and-freeze process.

Spray ice structures built in accordance with the present invention can also be used as relief well platforms, storage platforms and for other purposes, Inasmuch as the present invention is subject to many variations, modifications and changes in detail, it is intended that all subject matter discussed above and shown in the accompanying drawings be interpreted as illustrative and not in a limiting sense. Such variations modifications and changes in detail are included within the scope of the present invention as defined by the following claims.

What we claim is:

1. A method for constructing a spray ice structure in a body of water which is at least partially covered by floating ice, comprising the steps of:

(a) withdrawing water from the body of water when the temperature of the air is below the freezing temperature of the water;

(b) spraying the water upwardly and laterally in a stream through the air to cause the water to freeze into spray ice as it passes through the air; and (c) directing the stream to cause the spray ice to be deposited at a location on the floating ice which is laterally offset from the position from which the water is sprayed and to cause the spray ice thus deposited to build up into a grounded spray ice structure having an inner portion and an abutting outer portion which has a greater freeboard than the inner portion and which is adapted to both laterally confine the inner portion and to protect the inner portion from natural ice forces.

2. The method of claim 1 wherein buildup of the outer portion is completed after buildup of the inner 3. The method of claim 1 wherein the inner portion is surcharged with spray ice during step (c) and further comprising the step of removing the surcharge of spray ice from at least part of the inner portion after step (c).

4. The method of claim 3 and further comprising the step of leveling at least part of the inner portion during or after the step of removing the surcharge of spray ice.

5. The method of claim 3 and further comprising the step of compacting at least part of the inner portion during or after the leveling step.

6. The method of claim 1 wherein an opening is left in the outer portion to provide a passageway to the inner portion.

7. The method of claim 3 wherein an opening is left in the outer portion to provide a passageway to the inner portion and further comprising the step of making an access ramp through the passageway using the surcharge of spray ice removed from the inner portion.

8. A method for constructing a spray ice structure in a body of water which is at least partially covered by floating ice, comprising the steps of:

(a) withdrawing water from the body of water when the temperature of the air is below the freezing temperature of the water;

(b) spraying the water upwardly and laterally through the air to cause the water to freeze into spray ice as it passes through the air;

(c) directing the stream to cause the spray ice to be deposited at a location on the floating ice which is laterally offset from the position from which the water is sprayed and to cause the spray ice thus deposited to build up into a grounded spray ice structure having an inner portion and an abutting outer portion, wherein the inner portion is surcharged with spray ice, wherein buildup of the outer portion is completed after buildup of the inner portion, wherein the outer portion is built up until it has a greater freeboard than the inner portion, and until it is adapted to both laterally confine the inner portion and to protect the inner portion from natural ice forces, and wherein an opening is left in the outer portion to provide a passageway to the inner portion; and (d) removing the surcharge of spray ice from at least part of the inner portion.

9. The method of claim 8 and further comprising the step of leveling at least part of the inner portion during or after step (d).

10. The method of claim 9 and further comprising the step of compacting at least part of the inner portion during or after the leveling step.

11. The method of claim 10 and further comprising the step of making an access ramp through the passageway using the surcharge of spray ice removed from the inner portion during step (d).

12. A method for drilling a well in a body of water which is at least partially covered by floating ice, comprising the steps of;

(a) withdrawing water from the body of water when the temperature of the air is below the freezing temperature of the water;

(b) spraying the water upwardly and laterally in a stream through the air to cause the water to freeze into spray ice as it passes through the air;

(c) directing the stream to cause the spray ice to be deposited at a location on the floating ice which is laterally offset from the position from which the water is sprayed and to cause the spray ice thus deposited to build up into a grounded spray ice drilling structure having an inner drilling platform portion and an abutting outer barrier portion which has a greater freeboard than the barrier and which is adapted to both laterally confine the drilling platform portion and to protect the drilling platform portion from natural ice forces;

(d) mobilizing drilling equipment, supplies and facilities onto the drilling platform portion; and (e) drilling downward through the drilling platform portion and into a subterranean formation.

13. The method of claim 12 wherein buildup of the barrier portion is completed after buildup of the drilling platform portion.

14. The method of claim 13 wherein the drilling platform portion is surcharged with spray ice during step (c) and further comprising the step of removing the surcharge of spray ice from at least part of the drilling platform portion before step (d).

15. The method of claim 14 and further comprising the step of leveling at least part of the drilling platform portion during or after the step of removing the surcharge of spray ice and before step (d).

16. The method of claim 15 and further comprising the step of compacting at least part of the drilling platform portion during or after the leaving step and before step (d).

17. The method of claim 12 wherein an opening is left in the barrier portion to provide a passageway to the drilling platform portion.

18. The method of claim 14 wherein an opening is left in the barrier portion to provide a passageway to the drilling platform portion and further comprising the step of making an access ramp through the passageway using the surcharge of spray ice removed from the drilling platform portion.

19. A method for drilling a well in a body of water which is at least partially covered by floating ice, comprising the steps of:

(a) withdrawing water from the body of water when the temperature of the air is below the freezing temperature of the water;

(b) spraying the water upwardly and laterally through the air to cause the water to freeze into spray ice as it passes through the air;

(c) directing the stream to cause the spray ice to be deposited at a location on the floating ice which is laterally offset from the position from which the water is sprayed and to cause the spray ice thus deposited to build up into a grounded spray ice drilling structure having an inner drilling platform portion and an abutting outer barrier portion, wherein the drilling platform portion is surcharged with spray ice, wherein buildup of the barrier portion is completed after buildup of the drilling platform portion, wherein the barrier portion is built up until it has a greater freeboard than the drilling platform portion and until it is adapted to both laterally confine the drilling platform portion and to protect the drilling platfrom portion from natural ice forces, and wherein an opening is left in the barrier portion to provide a passageway to the drilling platform portion;

(d) removing the surcharge of spray ice from at least part of the drilling platform portion and leveling and compacting at least part of the drilling platform portion from which the spray ice is removed;

(e) adding a support surface over at least part of the leveled and compacted part of the drilling platform portion;

(f) mobilizing drilling equipment, supplies and facilities onto the support surface; and (g) drilling downward through the drilling platform portion and into a subterranean formation.

20. A spray ice structure located in a body of water which is at least partially covered by floating ice, comprising:

(a) an inner portion which extends from the bottom of the body of water to a level above the floating ice; and (b) an outer portion which abuts the inner portion which extends from the bottom of the body of water to a freeboard higher than the level of the inner portion, and which is adapted to both laterally confine the inner portion and to protect the inner portion from natural ice forces.

21. The spray ice structure of claim 20 wherein at least part of the inner portion is substantially level and compacted.

22. The spray ice structure of claim 20 wherein the outer portion surrounds most of the inner portion.

23. The spray ice structure of claim 20 wherein the outer portion has an opening which provides a passageway to the inner portion.

24. The spray ice structure of claim 23 and further comprising a spray ice ramp which extends through the passageway.

25. A spray ice drilling structure located in a body of water which is at least partially covered by floating ice, comprising:

(a) an inner drilling platform portion which extends from the bottom of the body of water to a level above the floating ice, at least part of the drilling platform portion being substantially level and compacted;

(b) an outer barrier portion which abuts the drilling platform portion which extends from the bottom of the body of water to a freeboard higher than the level of the drilling platform portion, and which is adapted to both laterally confine the drilling platform portion and to protect the drilling platform portion from natural ice forces, wherein the barrier portion surrounds most of the drilling platform portion and wherein the barrier portion has an opening which provides a passageway to the drilling platform portion; and (c) a spray ice ramp which extends through the passageway.

* * * * *